US009254412B2

(12) United States Patent
Chen et al.

(10) Patent No.: US 9,254,412 B2
(45) Date of Patent: Feb. 9, 2016

(54) ELLIPTICAL EXERCISER

(71) Applicant: Kun Shan University, Tainan (TW)

(72) Inventors: Fu-Chen Chen, Tainan (TW); Wei-Ren Chen, Tainan (TW); Meng-Hui Hsu, Tainan (TW)

(73) Assignee: KUN SHAN UNIVERSITY, Tainan (TW)

( * ) Notice: Subject to any disclaimer, the term of this patent is extended or adjusted under 35 U.S.C. 154(b) by 144 days.

(21) Appl. No.: 14/083,827

(22) Filed: Nov. 19, 2013

(65) Prior Publication Data

US 2015/0141208 A1 May 21, 2015

(51) Int. Cl.

| | |
|---|---|
| ***A63B 22/04*** | (2006.01) |
| ***A63B 22/06*** | (2006.01) |
| ***A63B 21/018*** | (2006.01) |
| ***A63B 21/068*** | (2006.01) |
| ***A63B 22/00*** | (2006.01) |
| *A63B 21/012* | (2006.01) |
| *A63B 21/22* | (2006.01) |

(52) U.S. Cl.

CPC ..... *A63B 22/0664* (2013.01); *A63B 21/018* (2013.01); *A63B 21/068* (2013.01); *A63B 22/001* (2013.01); *A63B 22/0015* (2013.01); *A63B 21/012* (2013.01); *A63B 21/225* (2013.01); *A63B 2022/067* (2013.01)

(58) Field of Classification Search

CPC ..... A63B 22/0664; A63B 22/001; A63B 21/225; A63B 22/04; A63B 22/0015; A63B 2022/067; A63B 2022/0682; A63B 22/0056

USPC ..... 482/51–53, 57

See application file for complete search history.

(56) References Cited

U.S. PATENT DOCUMENTS

| | | | | |
|---|---|---|---|---|
| 5,261,294 | A * | 11/1993 | Ticer et al. | 74/594.1 |
| 5,518,473 | A * | 5/1996 | Miller | 482/57 |
| 5,848,954 | A * | 12/1998 | Stearns et al. | 482/52 |
| 6,027,431 | A * | 2/2000 | Stearns et al. | 482/52 |
| 6,090,013 | A | 7/2000 | Eschenbach | |
| 6,206,804 | B1 * | 3/2001 | Maresh | 482/52 |
| 6,254,514 | B1 * | 7/2001 | Maresh et al. | 482/52 |
| 6,340,340 | B1 * | 1/2002 | Stearns et al. | 482/52 |
| 6,482,130 | B1 * | 11/2002 | Pasero et al. | 482/51 |
| 7,041,034 | B1 * | 5/2006 | Stearns et al. | 482/52 |
| 7,201,706 | B1 * | 4/2007 | Lee et al. | 482/52 |
| 7,497,810 | B1 * | 3/2009 | Stearns et al. | 482/52 |
| 2002/0094914 | A1 * | 7/2002 | Maresh et al. | 482/51 |
| 2002/0142890 | A1 * | 10/2002 | Ohrt et al. | 482/52 |
| 2004/0209741 | A1 * | 10/2004 | Kuo | 482/52 |
| 2006/0142123 | A1 * | 6/2006 | Kettler et al. | 482/52 |

(Continued)

*Primary Examiner* — Loan H Thanh
*Assistant Examiner* — Andrew S Lo
(74) *Attorney, Agent, or Firm* — Muncy, Geissler, Olds & Lowe, P.C.

(57) ABSTRACT

An exerciser includes a body and an adjustment wheel. The body has two flywheels and two foot support links. The two flywheels each have a sliding portion which radially connected thereto so as to guide the two foot support links to alternatively move along a supporting travel and a crossing travel to complete a closed pedal trajectory when the flywheels rotate. The timing adjustment wheel is pivotally connected to the body. The timing adjustment wheel has a first slider and a second slider, the first and second sliders are configured to move along the sliding portions of the flywheels. The foot support links drives the flywheel to rotate so that the first and second sliders move along the sliding portions to change the speeds and phase differences of the foot support links so as to meet the principles of ergonomics.

5 Claims, 8 Drawing Sheets

(56) References Cited

U.S. PATENT DOCUMENTS

2007/0238582 A1* 10/2007 Lee ..... 482/52
2008/0167164 A1* 7/2008 Wang ..... 482/52
2009/0111663 A1* 4/2009 Kuo ..... 482/53
2009/0170665 A1* 7/2009 Chu ..... 482/52
2013/0244837 A1* 9/2013 Chen ..... 482/52

* cited by examiner

ELLIPTICAL EXERCISER

FIELD OF THE INVENTION

The present invention relates to an elliptical exerciser, and more particularly, to an elliptical exerciser which can simulate the action of real jogging.

BACKGROUND OF THE INVENTION

Jogging is a popular exercise, but it is known that the jogger's knees are suffered from significant impact especially at the time that the user's foot contacts the ground. The knees will be injured after suffering from the frequent impacts for a period of time. Therefore, the exercisers such as elliptical exercisers, sliding exercisers and the like are developed to guide the users' feet to move along a track which is similar to that of real jogging such that the knees are protected from being impacted and injured.

One conventional elliptical exerciser is disclosed in U.S. Pat. No. 6,090,013 entitled "CROSS TRAINER EXERCISE APPARATUS", which comprises a framework, two handles, a flywheel and two foot support members, wherein the flywheel and the handles are pivotally connected to the framework, and the foot support members are pivotally connected to two sides of the flywheel. When the handles are pivotally moved, the foot support members are guided by the flywheel and moved along a pedal trajectory which comprises a supporting travel and a crossing travel.

However, the pedal trajectory provided by the conventional elliptical exerciser is a very elliptical trajectory, so that the pedal travels on two sides of the flywheel have 180 degrees of timing delay. The timing of pedal trajectory is quite different from the one of real jogging.

Specifically, the pivotal portions on two sides of the wheel have 180 degrees of phase difference, so that when one of the user's legs is at the front end of a pedal trajectory and going to support the user's weight, the other one is at the rear end of the pedal trajectory as shown in FIG. 8. In other words, the supporting travel A1 and the crossing travel A2 of the pedal trajectory A have almost the same path length. However, in real jogging, when one of the user's legs is at the front end of the trajectory and going to support the user's weight, the other one does not yet reach the rear end of the trajectory but keeps moving backward, and does not lift to move forward until reaches the rear end of the trajectory, as shown in FIG. 9. That is to say, in a trajectory B of real jogging, the path length of the supporting travel B1 is less than that of the crossing travel B2. The conventional elliptical exerciser cannot provide the user with the real jogging exercising mode and does not meet the principles of ergonomics.

When using the conventional elliptical exerciser, the user has to make his/her legs to be cooperated with the pedal trajectory provided by the conventional elliptical exerciser, so that the user cannot shift his/her weight from one leg to the other leg until his/her two legs both reach their respective extreme positions. The accumulation of the muscles sore and pain may cause sports injury to the user, and even worse if the user does not pedal at a correct angle.

The present invention intends to provide an elliptical exerciser with a timing adjustment wheel so as to perform as real jogging action.

SUMMARY OF THE INVENTION

The present invention relates to an elliptical exerciser. The elliptical exerciser comprises a body having a right flywheel, a left flywheel, a right foot support link and a left foot support link. The right flywheel has a right sliding portion connected to the right flywheel and extending from the interior of the right flywheel toward the exterior of the right flywheel, and the left flywheel has a left sliding portion connected to the left flywheel and extending from the interior of the left flywheel toward the exterior of the left flywheel. The right and left foot support links are pivotally connected to the right and left flywheels respectively such that each of the right and left foot support links alternatively moves within a supporting travel and a crossing travel to complete a closed pedal trajectory when the two flywheels rotate about their respective pivots. The elliptical exerciser also comprises a timing adjustment wheel having two sides in opposition and pivotally connected to the body, wherein a radial distance is designed between a rotation pivot of the timing adjustment wheel and the pivot of either of the right and left flywheels and allows the timing adjustment wheel and the right and left flywheels to rotate at different speeds. A first slider is pivotally connected to one of the two sides of the timing adjustment wheel. Contrary to the first slider, a second slider is pivotally connected to the other side of the timing adjustment wheel. The first slider and the second slider are configured to move along the right sliding portion and the left sliding portion respectively.

Preferably, the body has a resistance unit. The resistance unit comprises a resistance wheel and a transmission unit. The resistance wheel is pivotally connected to the body, and the transmission unit connects the resistance wheel with the timing adjustment wheel to increase rotation resistance of the timing adjustment wheel.

Preferably, the body has a right arm and a left arm which are pivotally connected to the body. The right and left arms are pivotally connected to the right and left foot support links respectively so as to move the right and left foot support links.

Preferably, each of the right and left sliding portions is a rail or a slot.

Preferably, each of the first and second sliders is a roller or a block

The primary object of the present invention is to provide an elliptical exerciser that the two foot support links on the two opposite sides of the timing adjustment wheel each have different speeds when moving within the crossing travel and within the supporting travel, such that the action mode is more similar to the jogging and protects the user from being injured.

The present invention utilizes the quick-return effect which allows that before one of the foot support links is transferred from the supporting travel to the crossing travel, the other foot support link is transferred from the crossing travel to the supporting travel earlier, so that the two legs do not need to stretch to their extreme positions when the user shifts his/her weight from one leg to the other one. This prevents the user from muscle sore and pain, and the timing of the trajectory of the foot support links meet the principles of ergonomics.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
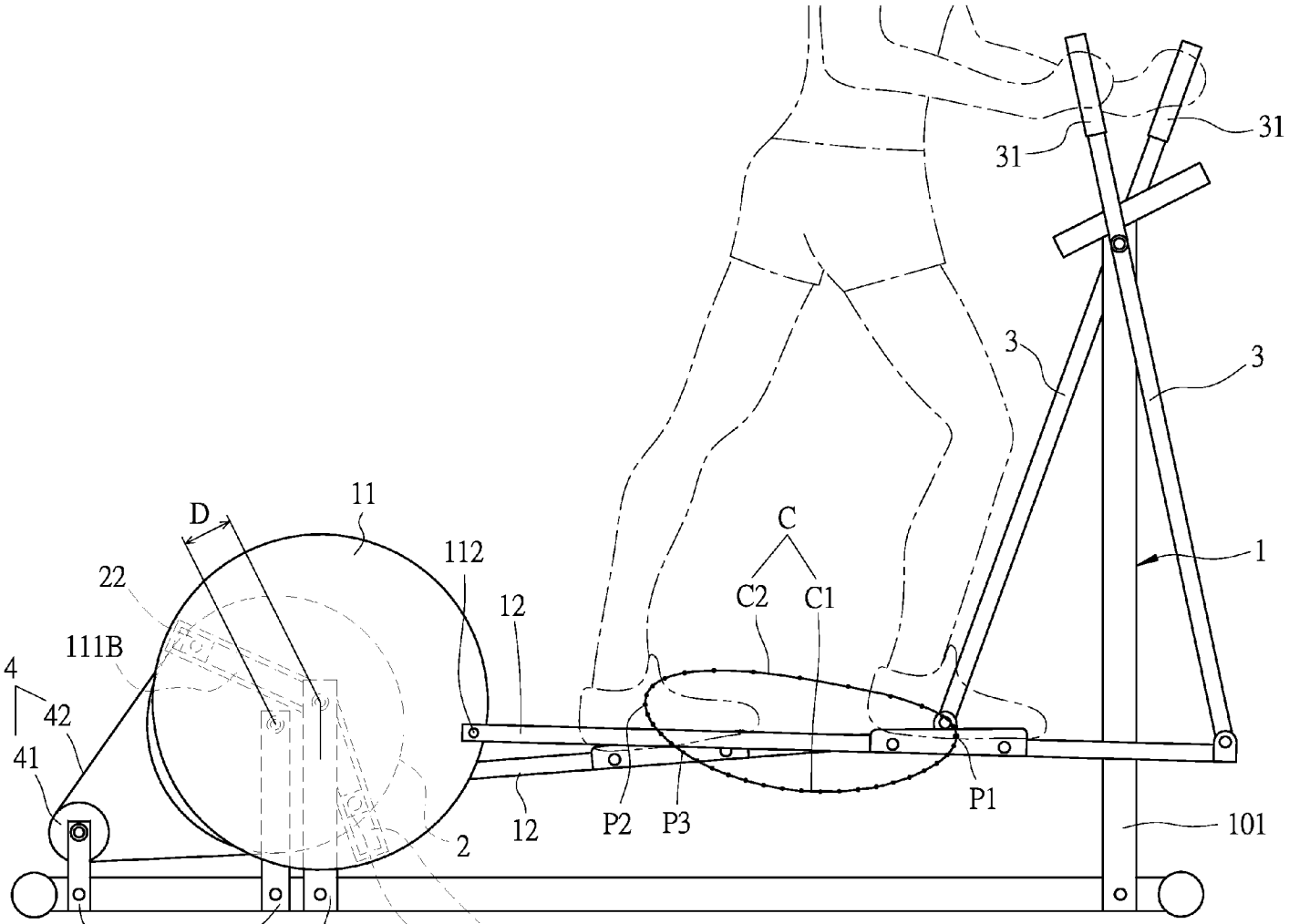
FIG. 1 is a plan view to show the elliptical exerciser in accordance with a preferred embodiment of the present invention.
Figure 2:
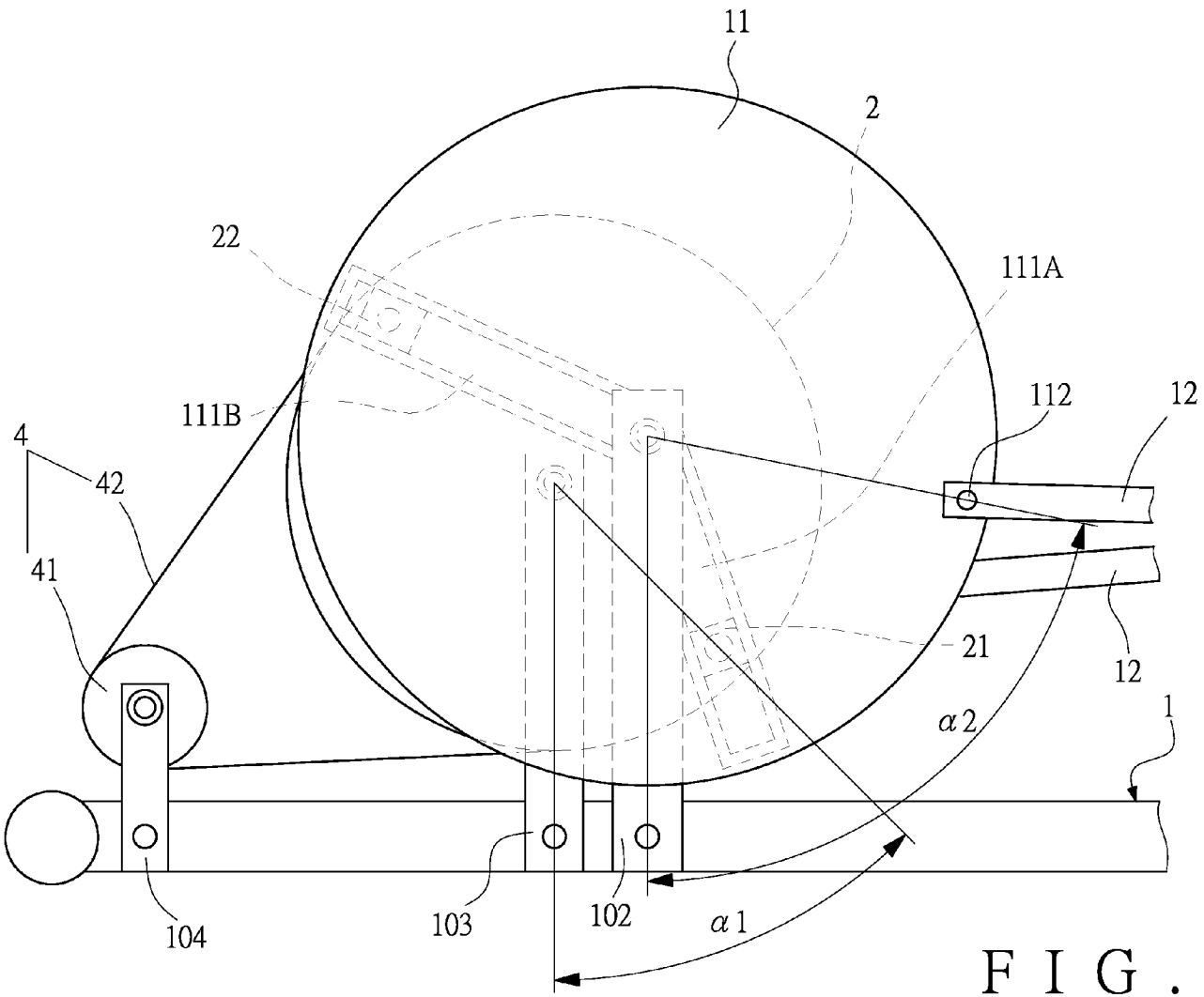
FIG. 2 is an enlarged view of a portion of the elliptical exerciser in FIG. 1.

FIGS. 1 and 2 show lateral views of an elliptical exerciser in accordance with a preferred embodiment of the present invention. The elliptical exerciser comprises a body 1 and a timing adjustment wheel 2.

Figure 3:
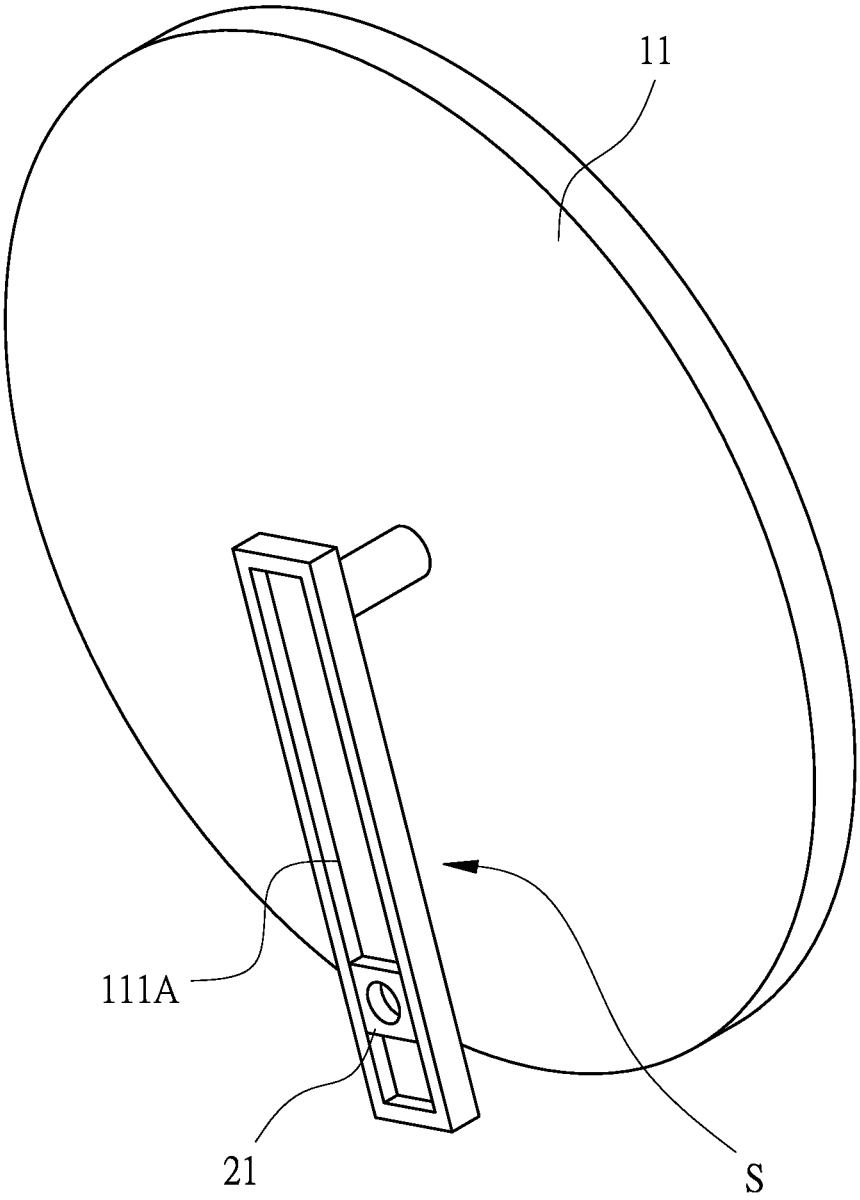
FIG. 3 is a perspective view to show the flywheel of the elliptical exerciser in accordance with the preferred embodiment of the present invention.

The body 1 comprises two flywheels 11 and two foot support links 12. The two flywheels 11 each have a sliding portion 111A/111B connected thereto. The sliding portions 111A, 111B each extend from the interior of its respective flywheel 11 toward the exterior of its respective flywheel 11. Referring to FIG. 3, taken one of the flywheels 11 as an example, the sliding portion 111A is connected to the flywheel 11, and a space S is defined between the sliding portion 111A and the flywheel 11. The space S prevents the flywheel 11 from being interfered by the sliding portion 111A when the flywheel 11 is rotated.

Furthermore, the two foot support links 12 each are pivotally connected to a respective one of the two flywheels 11. When the flywheels 11 are rotated about their respective pivots, the two foot support links 12 move along a closed pedal trajectory C. The pedal trajectory C comprises a supporting travel C1 (from P1 to P3) and a crossing travel C2 (from P3 to P1), wherein the path length of the supporting travel C1 is less than that of the crossing travel C2.

The timing adjustment wheel 2 is pivotally connected to the body 1 and has two sides in opposition. A radial distance D is designed between a rotation pivot of the timing adjustment wheel 2 and the pivot of either of the flywheels 11 and allows the timing adjustment wheel 2 and the flywheels 11 to rotate at different speeds. A first slider 21 is pivotally connected to one of the two sides of the timing adjustment wheel 2. Contrary to the first slider 21, a second slider 22 is pivotally connected to the other side of the timing adjustment wheel 2. The first slider 21 and the second slider 22 are configured to move along the sliding portions 111A, 111B, respectively.

Figure 6:
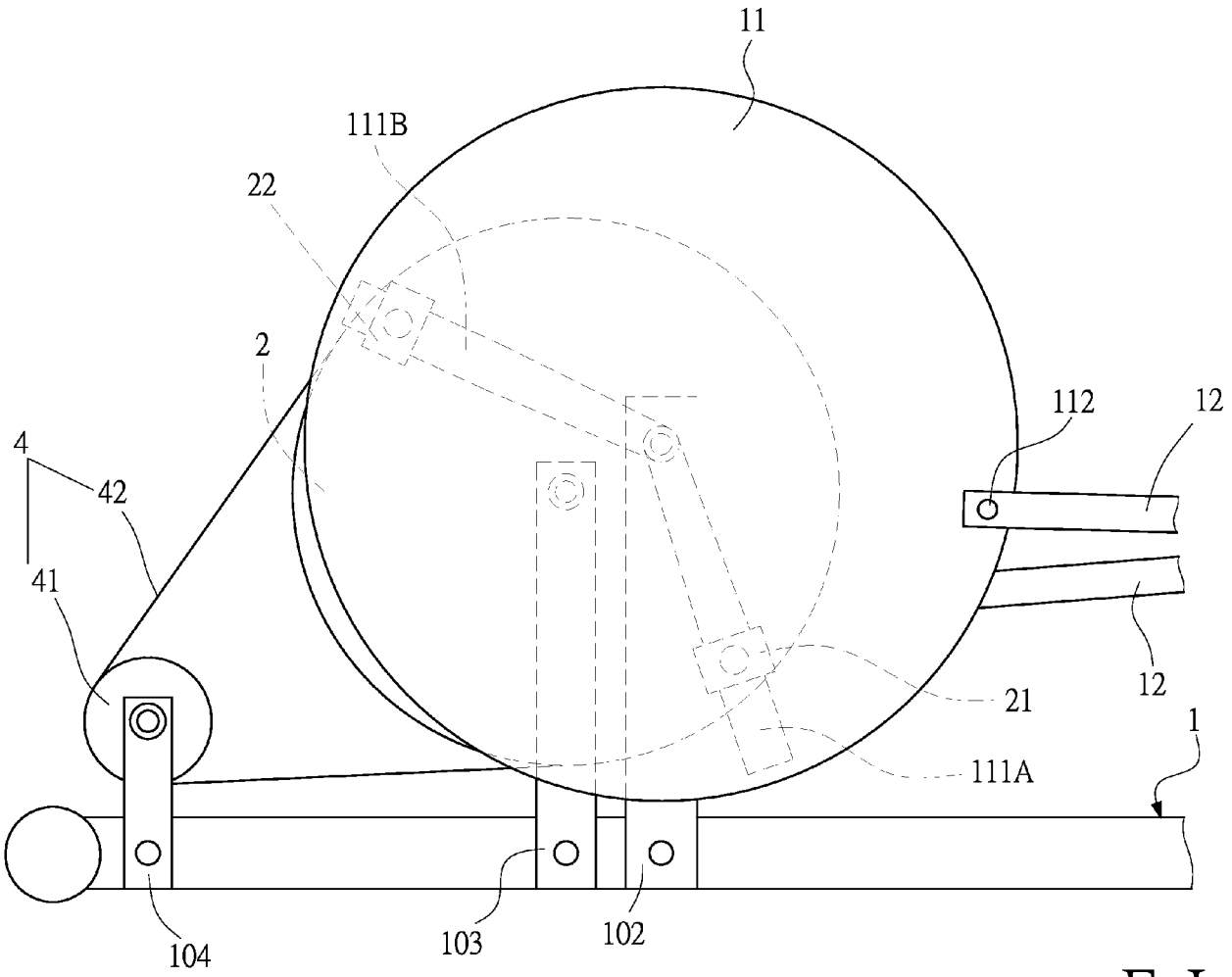
FIG. 6 shows another embodiment of the present invention wherein each of the sliding portions is a rail.
Figure 7:
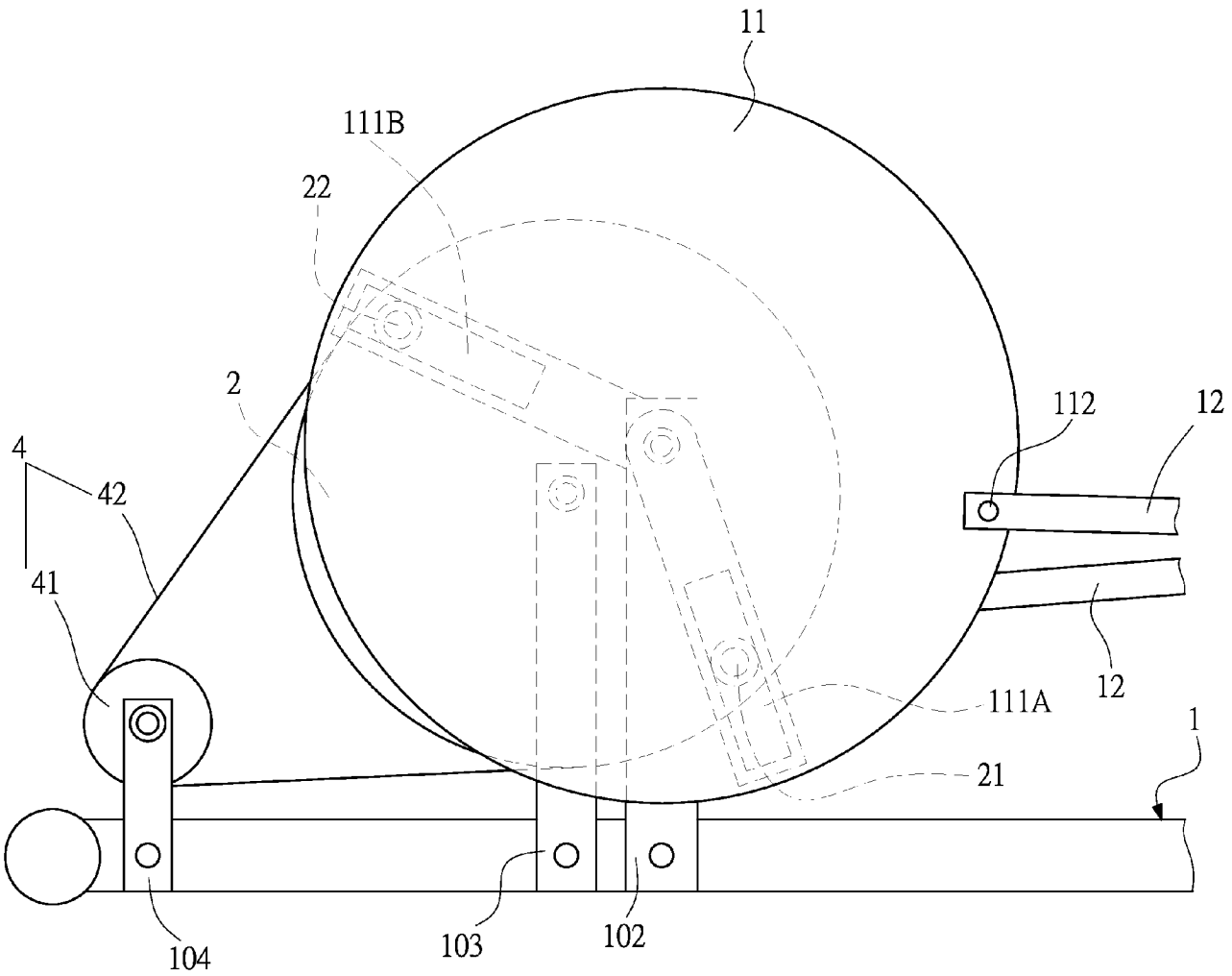
FIG. 7 shows yet another embodiment of the present invention wherein each of the first and second sliders is a roller.
Figure 8:
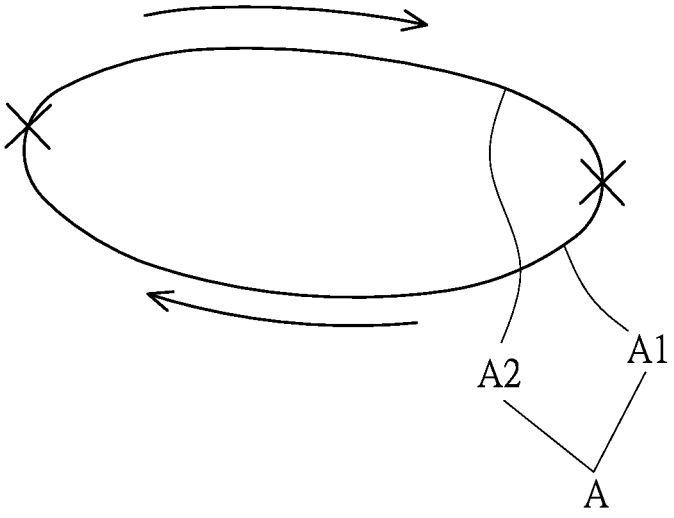
F I G . 8 (PRIOR ART)
FIG. 8 shows the pedal trajectory of a conventional elliptical exerciser.
Figure 9:
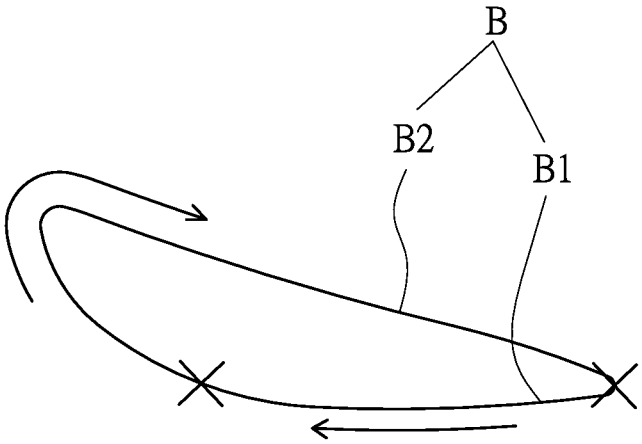
FIG. 9 is the trajectory of real jogging.

It should be noted that the sliding portions 111A, 111B of the flywheels 11 each may be a slot, a rail as shown in FIG. 6, or other configurations which allow the first and second sliders 21, 22 to move along. Also, the first and second sliders 21, 22 each may be a block or a roller as shown in FIG. 7, which can reduce the sliding resistance.

Preferably, the elliptical exerciser has two arms 3 which are pivotally connected to the body 1, and the two arms 3 each are pivotally connected to a respective one of the foot support links 12. Therefore, the foot support links 12 are relatively moved by swinging the two arms 3. Each of the arms 3 has a handle 31 disposed thereon so that the user can grasp the two handles 31 to swing his/her arms as in real jogging.

Preferably, the elliptical exerciser further comprises a resistance unit 4. The resistance unit 4 comprises a resistance wheel 41 and a transmission unit 42. The resistance wheel 41 is pivotally connected to the body 1. The transmission unit 42 is a chain or a belt and connects the resistance wheel 41 with the timing adjustment wheel 2 to increase the rotation resistance of the timing adjustment wheel 2.

Specifically, in this embodiment, the body 1 has a first post 101, a second post 102, a third post 103 and a fourth post 104. The two arms 3 are pivotally connected to the first post 101. The two flywheels 11 are pivotally connected to the second post 102. The timing adjustment wheel 2 is pivotally connected to the third post 103. The resistance wheel 41 is pivotally connected to the fourth post 104. The two flywheels 11 each have a pivotal portion 112 pivotally connected to a respective one of the foot support links 12.

An exemplified movement of the elliptical exerciser is described in the following. Firstly, FIG. 1 shows that a user stands on the two foot support links 12, wherein one of the two foot support links 12 is pedaled by the user's right foot and located at a first end P1, and the other one of the two foot support links 12 is pedaled by the user's left foot and located at a third end P3. Correspondingly, the first slider 21 is located at a first position (as shown in FIG. 1) of the sliding portion 111A, and the second slider 22 is located at a second position (as shown in FIG. 1) of the sliding portion. 111B at that time. Wherein, the third end P3 is located before a second end P2, the first end P1 is the front end of the pedal trajectory C, and the second end P2 is the rear end of the pedal trajectory C.

Accordingly, when the foot support link 12 pedaled by the user's right foot is pedaled downward, the flywheel 11 connected with the sliding portion 111A is driven to rotate about the pivot of the flywheel 11 connected with the sliding portion 111. Thereby, the timing adjustment wheel 2 is driven to rotate according to the relative movement between the first slider 21 and the sliding portion 111A and further drives the flywheel 11 connected with the sliding portion 111B to rotate according to the relative movement between the second slider 22 and the sliding portion 111B so as to guide the foot support link 12 pedaled by the user's left foot to move upward.

Figure 4:
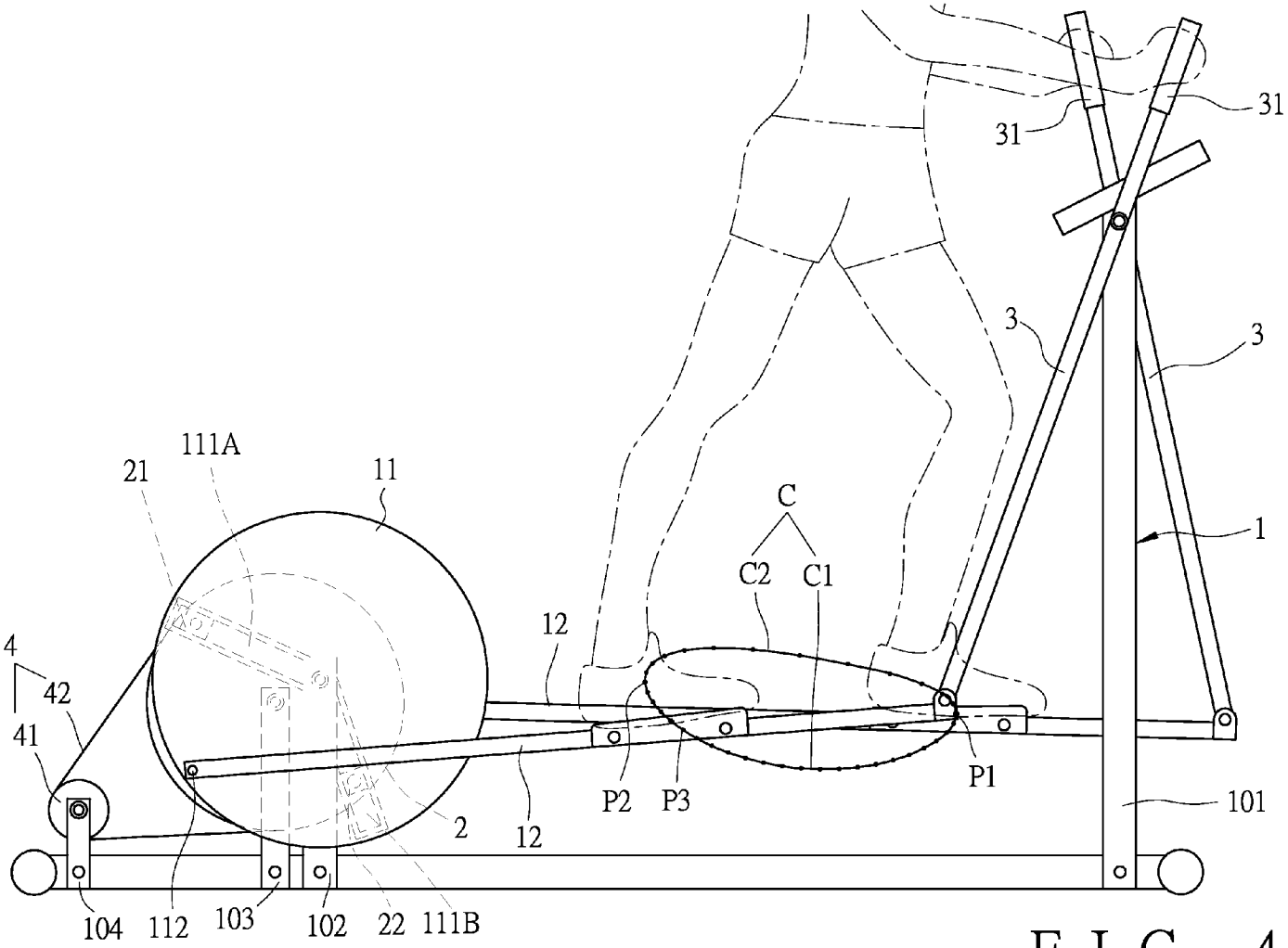
FIG. 4 shows the movement of the foot support links of the elliptical exerciser in accordance with the preferred embodiment of the present invention.

Furthermore, referring to FIG. 4, when the foot support link 12 pedaled by the user's right foot is pedaled to complete the supporting travel C1 and reaches the third end P3, the foot support link 12 pedaled by the user's left foot is guided to complete the crossing travel C2 and reaches the first end P1 Correspondingly, the first slider 21 is located at a second position (as shown in FIG. 4) of the sliding portion 111A, and the second slider 22 is located at a first position (as shown in FIG. 4) of the sliding portion 111B at that time.

More specifically, each of the sliding portions 111A/111B has an interior end and an exterior end, wherein the interior end is near the pivots of the flywheels 11, and the exterior end is near the peripheral areas of the flywheels 11. During the supporting travel C1 of the foot support link 12 pedaled by the user's right foot, the first slider 21 is moved from the first position (as shown in FIG. 1) of the sliding portion 111A toward the exterior end of the sliding portion 111A to reach the second position (as shown in FIG. 4) of the sliding portion 111A and, during the same period of time, the second slider 22 is moved from the second position (as shown in FIG. 1) of the sliding portion 111B toward the interior end of the sliding portion 111B until the second slider 22 arrives at the interior end of the sliding portion 111B and then is moved toward the exterior end of the sliding portion 111B to reach the first position (as shown in FIG. 4) of the sliding portion 111B. Accordingly, the flywheel 11 connected with the sliding portion 111B is accelerated to guide the foot support link 12 pedaled by the user's left foot to complete the crossing travel C2 during the same period of time, and thereby the rotational speed of the flywheel 11 connected with the sliding portion 111A is slower than the rotational speed of the flywheel 11 connected with the sliding portion 111B. By utilizing the quick-return effect to repeatedly switch the rotational speeds of the two flywheels 11, the two foot support links 12 each are driven to have different speeds and phase differences when moving within the crossing travel C2 and the supporting travel C1, and the timing of pedal trajectory C is therefore more similar to the one of real jogging.

Figure 5:
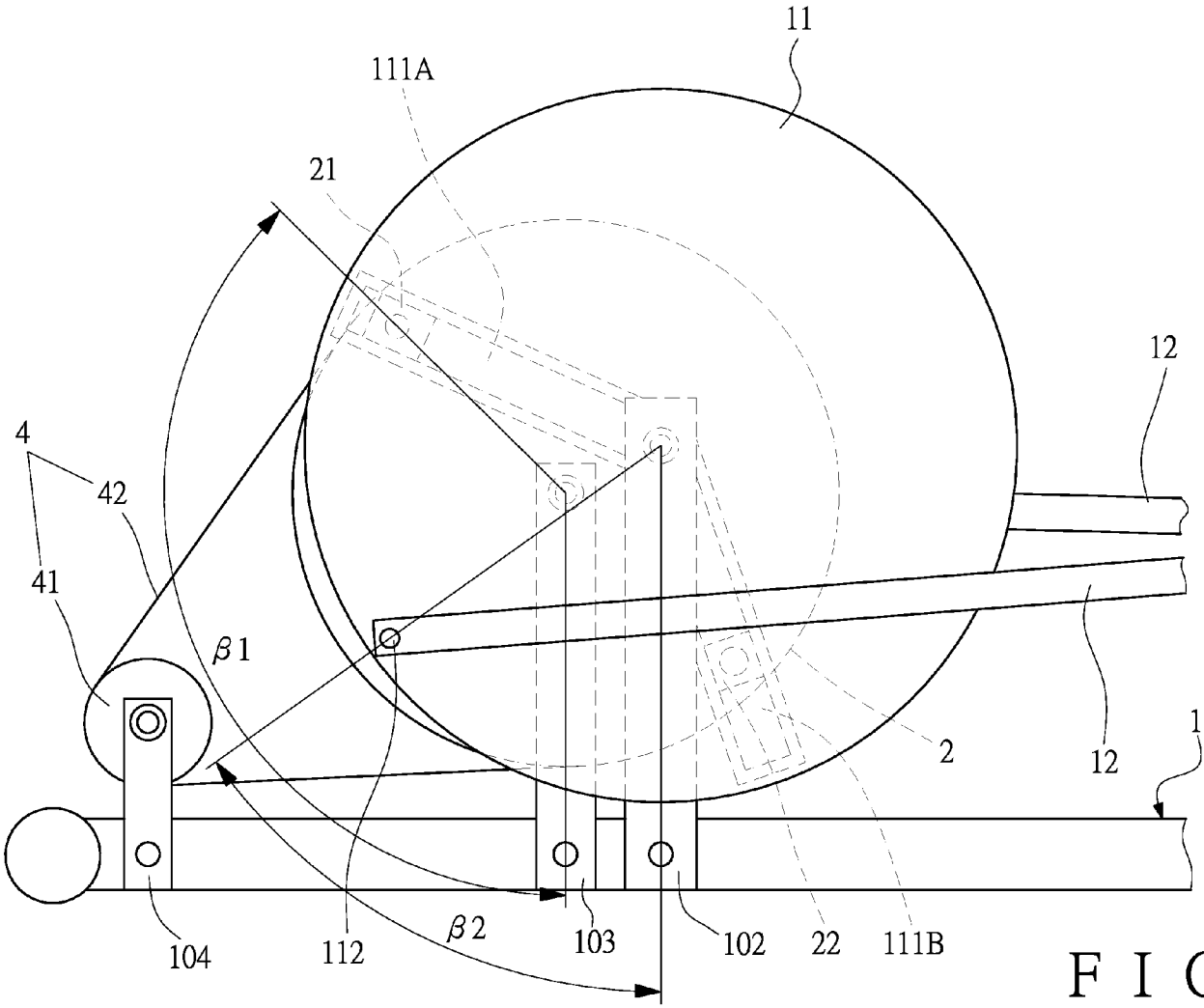
FIG. 5 is an enlarged view to show a portion of the elliptical exerciser in FIG. 4.

The quick-return effect for producing phase differences is further explained in accordance with the exemplified movement of the elliptical exerciser as shown in FIGS. 1, 2, 4, 5. First, it is known from the exemplified movement mentioned above that the rotational speed of the timing adjustment wheel 2 is faster than that of the flywheel 11 connected with the sliding portion 111A when the foot support link 12 pedaled by the user's right foot moves within the supporting travel C1. Therefore, when the timing adjustment wheel 2 rotates clockwise 180 degrees (i.e. the sum of the angle $\alpha$1 in FIG. 2 and the angle $\beta$1 in FIG. 5 is 180 degrees), the flywheel 11 connected with the sliding portion 111A has not rotated 180 degrees (i.e. the sum of the angle $\alpha$2 in FIG. 2 and the angle $\beta$2 in FIG. 5 is less than 180 degrees); namely, the foot support link 12 pedaled by the user's right foot is located at the third end P3 rather than the second end P2 when the foot support links 12 pedaled by the user's left foot just reaches the front end of the pedal trajectory C. As the user's left foot reaches the supporting travel C1 before the user's right foot is lifted forward, the user can shift his/her weight from one leg to the other one before his/her two legs both are stretched to their respective extreme positions such that the user is prevented from muscle sore and pain. The timing of pedal trajectory C provided by the elliptical exerciser of the present invention is similar to the one of real jogging and meets the principles of ergonomics.

While we have shown and described the embodiment in accordance with the present invention, it should be clear to those skilled in the art that further embodiments may be made without departing from the scope of the present invention.

What is claimed is:

1. An elliptical exerciser comprising:

a body including:

a bottom frame extending in a longitudinal direction;

a first post fixedly mounted on the bottom frame;

a second post fixedly mounted on the bottom frame;

a third post fixedly mounted on the bottom frame and spaced longitudinally apart from the second post;

a right flywheel having a central pivot mounted pivotally to a right side of the second post, wherein the right flywheel has a first sliding portion securely connected therewith, extending from a radial center of the right flywheel, and terminating on a periphery of the right flywheel;

a left flywheel having a central pivot mounted pivotally to a left side of the second post, wherein the left flywheel has a second sliding portion securely connected therewith, extending from a radial center of the left flywheel, and terminating on a periphery of the left flywheel;

a right foot support link having one end pivotally connected to the right flywheel; and a left foot support link having one end pivotally connected to the left flywheel;

a timing adjustment wheel having a central pivot mounted pivotally to the third post of the body, such that a constant radial distance is defined between the central pivot of the timing adjustment wheel and the central pivot of either of the right and left flywheels, and the timing adjustment wheel and the right and left flywheels are enabled to rotate at different speeds;

a first slider movable along the first sliding portion of the right flywheel and mounted with a first peripheral pivot formed on a right side of the timing adjustment wheel; and a second slider movable along the second sliding portion of the left flywheel and mounted with a second peripheral pivot formed on a left side of the timing adjustment wheel.

2. The elliptical exerciser as claimed in claim 1, wherein the body has a resistance unit, the resistance unit comprises a resistance wheel and a transmission unit, the resistance wheel is pivotally connected to the body, and the transmission unit connects the resistance wheel with the timing adjustment wheel to increase rotation resistance of the timing adjustment wheel.

3. The elliptical exerciser as claimed in claim 1, wherein the body further includes a right arm pivotally connected to an other end of the right foot support link and a left arm connected to an other end of the left foot support link so as to move the right and left foot support links.

4. The elliptical exerciser as claimed in claim 1, wherein each of the first and second sliding portions is a rail or a slot.

5. The elliptical exerciser as claimed in claim 1, wherein each of the first and second sliders is a roller or a block.

* * * * *